33-241 SR
4/20/82 XR 4,325,190

United States Patent [19]

Duerst

[11] 4,325,190

[45] Apr. 20, 1982

[54] BOW SIGHT

[76] Inventor: Thomas Duerst, 720 Balcom St., Eau Claire, Wis. 54701

[21] Appl. No.: 180,669

[22] Filed: Aug. 25, 1980

[51] Int. Cl.[3] ..... F41G 1/00

[52] U.S. Cl. ..... 33/265; 33/241; 33/366

[58] Field of Search ..... 33/241, 265, 366, 341, 33/348; 124/87; 340/686, 689; 200/220

[56] References Cited

U.S. PATENT DOCUMENTS

| | | | |
|---|---|---|---|
| 1,251,349 | 12/1917 | Day | 33/366 |
| 1,815,949 | 7/1931 | Marischal | 33/383 |
| 2,338,811 | 1/1944 | Hasbrook | 33/366 |
| 3,074,049 | 1/1963 | Saliba et al. | 200/220 X |
| 3,945,127 | 3/1976 | Spencer | 33/265 |
| 4,048,726 | 9/1977 | LeFebvre | 33/180 R |
| 4,120,096 | 10/1978 | Keller | 33/265 |
| 4,134,383 | 1/1979 | Flood | 124/24 R |
| 4,170,071 | 10/1979 | Mann et al. | 33/265 |
| 4,177,572 | 12/1979 | Hindes | 33/265 |
| 4,179,613 | 12/1979 | Koren | 33/265 X |

*Primary Examiner*—Harry N. Haroian
*Attorney, Agent, or Firm*—Andrus, Sceales, Starke & Sawall

[57] ABSTRACT

A bow sight for determining proper range includes an energy source and a series of mercury tilt switches, each of which becomes operable at a different predetermined angle of bow inclination. A series of light emitting sight pins are connected to the tilt switches via an electronic circuitry that allows for the energization of a different sight pin for a different angle of bow inclination.

5 Claims, 3 Drawing Figures

FIG.1
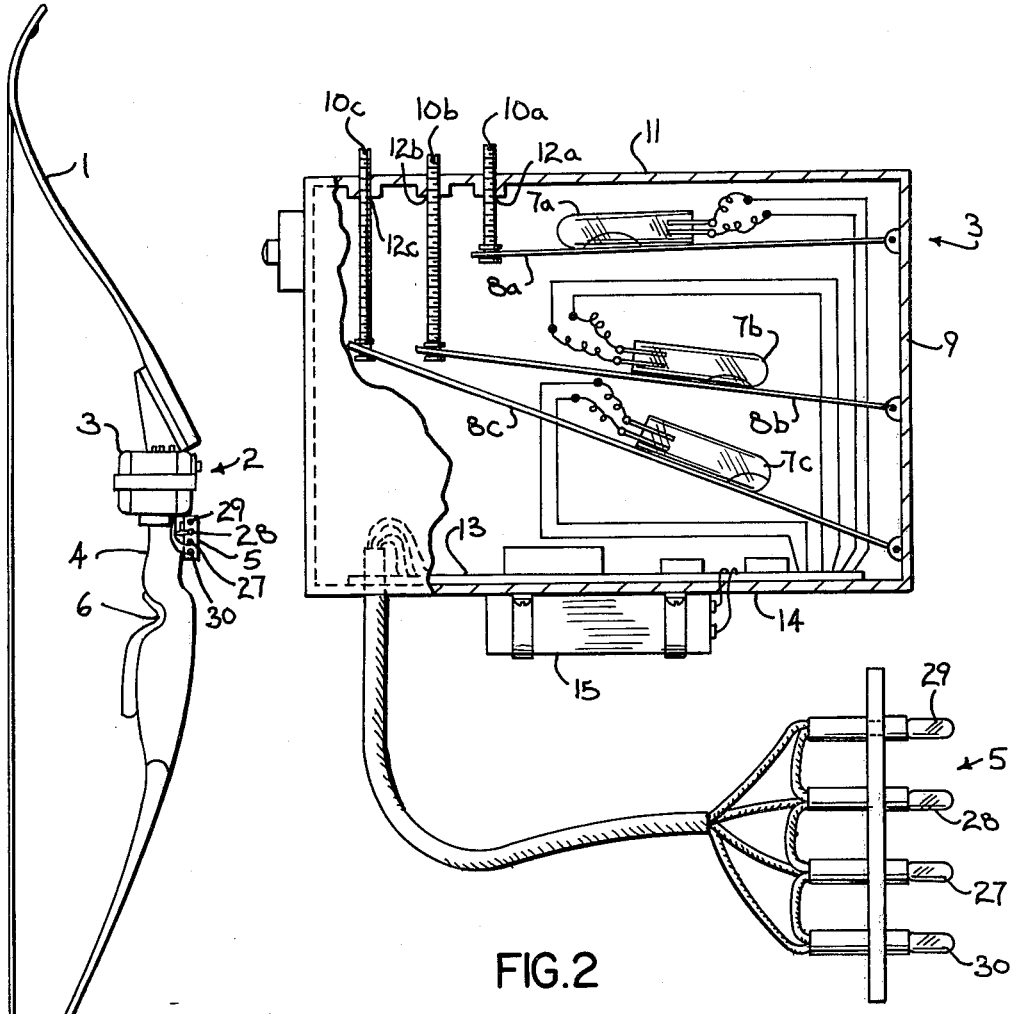
FIG.2
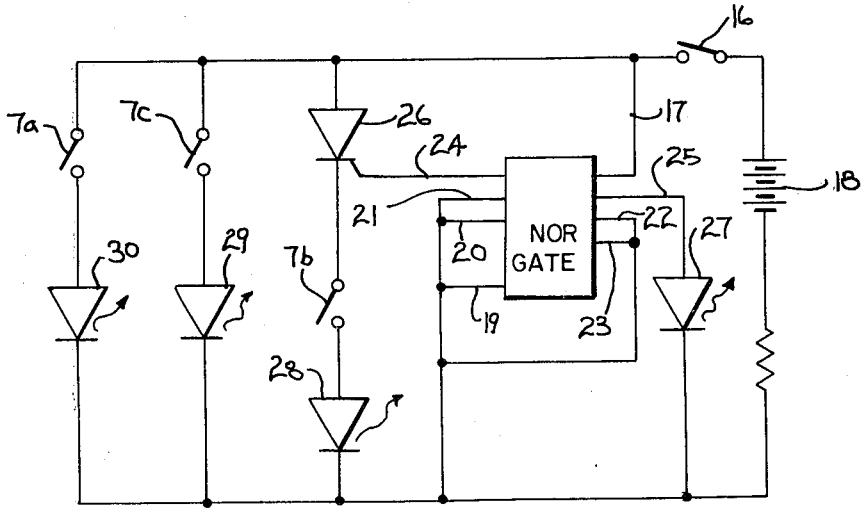
FIG.3

BOW SIGHT

BACKGROUND OF THE INVENTION

This invention relates to bow sights and more particularly to range finder bow sights utilizing light emitting sight pins.

Heretofore devices have been developed to assist an archer in consistently drawing the bow string to a predetermined postion and to assist the archer in maintaining the bow perpendicular to the horizon.

Sights such as those in U.S. Pat. No. 3,945,127 to Spencer and U.S. Pat. No. 4,170,071 to Mann have utilized a plurality of light emitting sight pins, however since all of the sight pins light up upon energization of the device, the selection of the correct sight pin for the proper range is still left to the archer's judgment. Thus the lighted sight pins served as optical aids rather than as ranger finders.

Range finder sights such as that shown in U.S. Pat. No. 4,120,096 to Keller utilize sight pins that pivot mechanically as the bow is angled to different elevations. Sights such as this have an undesirable sway about the pivot point making sighting difficult. Also since the sight pins are not lit, the correct pin for sighting purposes may be in doubt.

SUMMARY OF THE INVENTION

The bow sight constructed in accordance with the present invention is designed to help a bow hunter sight for the correct range, whether the hunter is shooting from an elevated tree stand or from the ground.

In accordance with one aspect of the invention, the sight includes a series of mercury tilt switches which become operable at a variety of different angles of bow inclination.

In accordance with another aspect of the invention, the sight includes a series of light emitting sight pins operably connected to the tilt switches.

In accordance with yet another aspect of the invention, the sight includes electronic circuitry that allows for the energization of different sight pins at different predetermined angles of bow inclination.

The present invention thus provides the archer with a sight having a plurality of light emitting sight pins, only one of which is lit at any one moment. The energization of a sight pin being determined by the angle of inclination of the bow. The sight thus serves as a range finder and as an optical aid.

The present invention also contains no moving or mechanical parts that could serve as a distraction to the sighting archer or cause unwanted noise during the sighting process.

DESCRIPTION OF THE DRAWINGS

The drawings illustrate the best mode presently contemplated of carrying out the invention.

In the drawings:

FIG. 1 is a side elevation of a bow utilizing the sight of the present invention;

FIG. 2 is a side cross-sectional view of the control box for the sight with the sight pins depending therefrom; and FIG. 3 is a schematic diagram of the electronic circuit employed in the present invention.

DESCRIPTION OF THE PREFERRED EMBODIMENT

The sight of the present invention is designed to be utilized with a hunting bow 1. Sight 2 includes control box 3 mounted on the upper portion of the center section 4 of bow 1. A series of light emitting sight pins 5 depend from control box 3 and is mounted on bow 1 just above grip 6.

As shown in FIG. 2, control box 3 contains a series of three mercury tilt switches *7a, 7b* and *7c*. Each of these switches is mounted on a plate 8*a, 8b* and 8*c* one end of which pivotally connected to casing side wall 9, the other end being connected to the bottom of adjustment screws 10*a, 10b* and 10*c*. Adjustment screws 10*a, 10b* and 10*c* are threaded and extend through upper casing wall 11 via threaded holes 12*a, 12b* and 12*c*. Rotation of the threaded adjustment screws allows for the calibration of the sight.

The electrical leads from switches *7a, 7b* and *7c* are connected to circuit board 13 mounted on bottom casing wall 14. The electrical leads from sight pins 5 and battery 15 pass through the bottom casing wall 14 and are connected to circuit board 13.

The electrical components of circuit board 13 are illustrated in FIG. 3. The electrical components and their inter-relationship can be best described by a discussion of the operation of the sight and its electrical components.

The sight is activated by manually closing on-off switch 16. Closing switch 16 provides power to the NOR gates via connection 17 connected to the plus terminal of battery 18 and connection 19 connected to the negative side of battery 18.

When the bow is tilted for approximately 75% of maximum range mercury switches *7a, 7b* and *7c* are open. The signal from these switches arrives at NOR gate terminals 20, 21, 22, and 23. Since switches *7a, 7b* and *7c* are all open, NOR gate terminals 20–23 sense zero voltage and the NOR gate turns on output terminals 24 and 25. The signal from terminal 24 triggers silicon controlled rectifier (SCR) 26 but the signal passing through SCR 26 is dead-ended at open switch *7b*. The signal from NOR gate output terminal 25 energizes light emitting diode 27. So a bow position approximating 75% of maximum range results in sight pin 27 being lit.

As the bow is tilted downward from its approximate maximum range position for closer range switch *7b* closes. NOR gate terminals 20–23 still sense zero voltage so as before a positive signal is produced at terminals 24 and 25. The signal from terminal 24 triggers SCR 26 and the signal now passing through closed switch *7b* energizes light emitting diode 28. NOR gate terminals 20–23 immediately sense a positive voltage and the NOR gate turns off terminals 24 and 25. However, once SCR 26 fires, it continues to conduct even though gate voltage 24 has returned to zero. Thus a slightly greater downward inclination of the bow results in sight pin 28 being lit.

As the bow is angled even further downward for extremely close range both switches *7b* and *7c* are closed. The current flow through switch *7c* and light emitting diode 29 causes the current flowing through SCR 26 to fall below the threshold value and SCR 26 therefore stops conducting. Thus an extreme downward tilt results in sight pin 29 being lit.

If the bow is raised up for maximum range, switch 7*a* will be closed while switches 7*b* and 7*c* are open. NOR gate terminal 20–23 sense a positive voltage and NOR gate terminals 20–25 are turned off. Thus a tilt of the bow for maximum range results in sight pin 30 being lit.

By utilizing adjustment screws 10*a*, 10*b* and 10*c*, the tilt of mounting plates 8*a*, 8*b* and 8*c* may be varied and the sight may be calibrated for various hunting positions.

Various modes of carrying out the invention are contemplated as being within the scope of the following claims particularly pointing out and distinctly claiming the subject matter which is regarded as the invention.

I claim:

1. A bow sight comprising:

a. a casing for mounting on the bow, b. an electrical energy source mounted on said casing, c. a plurality of switches mounted in said casing, each of said switches being operable by a different predetermined vertical inclination of the bow, d. a plurality of light emitting sight pins connected to the bow in a vertically spaced relationship, said sight pins operably connected to said energy source through said switches, each of said sight pins being designated for use at a preselected shooting range and e. circuit means mounted in said casing and operable to selectively energize one of said sight pins upon detection of each of said different predetermined angles of bow inclination by one of said switches whereby the designated sight pin is illuminated for the preselected shooting range corresponding to said predetermined bow inclination.

2. The bow sight of claim 1 further comprising a plurality of adjustment means connected to said casing, each of said adjustment means operably connected to one of said switches whereby the predetermined angle at which said switch becomes operable may be varied by said corresponding adjustment means in order to select a plurality of shooting ranges corresponding to different shooting positions.

3. The bow sight of claim 1 wherein said switches comprise a plurality of mercury switches, each of said switches becoming operable at a predetermined angle of bow inclination.

4. The bow sight of claim 1 wherein said light emitting sight pins comprise a plurality of light emitting diodes.

5. The bow sight of claim 1 wherein said circuit means comprises a pair of NOR gates operably connected to said energy source through said switches and a silicon controlled rectifier (SCR) operable by the output of one of said NOR gates, said SCR being in series with one of said switches, the output of the other of said NOR gates operably connected to one of said sight pins, whereby upon detection of a predetermined angle by one of said switches only one of said light emitting sight pins will be energized.

* * * * *